US009364135B2

(12) United States Patent
Lee

(10) Patent No.: US 9,364,135 B2
(45) Date of Patent: Jun. 14, 2016

(54) CLEANING WAND AND CLOTH SYSTEM

(71) Applicant: Jackie M. Lee, New York, NY (US)

(72) Inventor: Jackie M. Lee, New York, NY (US)

( * ) Notice: Subject to any disclaimer, the term of this patent is extended or adjusted under 35 U.S.C. 154(b) by 0 days.

(21) Appl. No.: 14/464,252

(22) Filed: Aug. 20, 2014

(65) Prior Publication Data

US 2016/0051117 A1 Feb. 25, 2016

(51) Int. Cl.

| | |
|---|---|
| ***A47L 13/44*** | (2006.01) |
| ***A47L 17/00*** | (2006.01) |
| ***B08B 9/087*** | (2006.01) |

(52) U.S. Cl.

CPC ..... *A47L 17/00* (2013.01); *A47L 13/44* (2013.01); *B08B 9/087* (2013.01)

(58) Field of Classification Search

CPC ..... B08B 9/04; B08B 9/087

See application file for complete search history.

(56) References Cited

U.S. PATENT DOCUMENTS

| | | | | | |
|---|---|---|---|---|---|
| 78,528 | A * | 6/1868 | Lee | 15/211 | |
| 1,325,292 | A * | 12/1919 | Hood | 15/104.165 | |
| 1,373,999 | A * | 4/1921 | Drummond | 15/104.19 | |
| 1,375,088 | A * | 4/1921 | Fries | 15/105 | |
| 1,546,475 | A * | 7/1925 | Cook | F41A 29/02 | 15/104.165 |
| 1,577,423 | A * | 3/1926 | Mugaas | 15/104.165 | |
| 2,184,216 | A * | 12/1939 | Gross | 294/26 | |
| 2,297,566 | A * | 9/1942 | Laux | 30/169 | |
| 2,597,400 | A * | 5/1952 | Rassieur | A45B 3/00 | 135/65 |
| 2,610,884 | A * | 9/1952 | Enderle | A47G 21/00 | 294/15 |
| 2,828,502 | A * | 4/1958 | Tupper | 15/121 | |
| 2,856,738 | A * | 10/1958 | Deuschle | B24B 33/08 | 15/104.165 |
| D187,133 | S * | 2/1960 | Walters | D8/71 | |
| 3,205,518 | A * | 9/1965 | Romaine | 15/104.165 | |
| 3,488,790 | A * | 1/1970 | Satoh | 15/118 | |
| 4,499,625 | A * | 2/1985 | Bottomley | 15/104.165 | |
| 4,953,906 | A * | 9/1990 | White | A63B 47/02 | 294/19.2 |
| 5,127,179 | A * | 7/1992 | Marsh | F41C 9/085 | 42/90 |
| 5,445,632 | A * | 8/1995 | Blake | A61F 2/06 | 606/1 |
| 5,813,120 | A * | 9/1998 | Stroh | 30/123 | |
| 6,094,765 | A * | 8/2000 | Askenase | 15/104.05 | |
| 6,280,455 | B1 * | 8/2001 | Ginn | A61B 17/00008 | 606/159 |
| 8,276,238 | B2 * | 10/2012 | Young | B44D 3/006 | 15/236.03 |
| D706,161 | S * | 6/2014 | Madrid | D11/130 | |
| 8,806,696 | B2 * | 8/2014 | Mowe | B05C 17/0245 | 15/104.04 |
| D739,293 | S * | 9/2015 | Penrod | D11/130 | |
| 2003/0056810 | A1 * | 3/2003 | Petit | 134/8 | |

* cited by examiner

*Primary Examiner* — Randall Chin

(74) *Attorney, Agent, or Firm* — Dunlap, Bennett & Ludwig PLLC

(57) ABSTRACT

A cleaning wand and cloth system includes a wand having a first end and a second end. The first end of the wand has a handle, and the second end of the wand has a tip including an opening. The tip may be coiled shaped. A cloth, such as a washing cloth, a drying cloth, and the like, may be removably attached to the tip of the wand one at a time. The washing cloth and the drying cloth may each have an attachable loop that may removably attach to the tip of the wand. The tip of the wand and the removably attached cloth may be placed within a narrow hollow object to clean the interior surfaces.

6 Claims, 3 Drawing Sheets

CLEANING WAND AND CLOTH SYSTEM

BACKGROUND OF THE INVENTION

The present invention relates to cleaning devices and, more particularly, to a cleaning wand and cloth system.

Washing and drying household items with narrow and odd shaped opening such as with wine decanters, oil and vinegar bottles and the like can be difficult with current devices. Many times, the bottom of the opening of these objects remain dirty due to lack of access.

As can be seen, there is a need for a cleaning wand and cloth system that washes and dries narrow and non standard shaped objects.

SUMMARY OF THE INVENTION

In one aspect of the present invention, a cleaning wand and cloth system comprises: a wand comprising a first end and a second end, wherein the first end comprises a handle, wherein the second end comprises a tip comprising an opening.

In another aspect of the present invention, a method for preparing a system to clean a narrow shaped hollow object comprises: removably securing a washing cloth onto a tip of a wand, wherein the wand comprises a first end and a second end, wherein the first end comprises a handle, wherein the second end comprises the tip comprising an opening.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a cleaning wand and cloth system that includes a wand having a first end and a second end. The first end of the wand has a handle, and the second end of the wand has a tip including an opening. The tip may be coiled shaped. A cloth, such as a washing cloth, a drying cloth, and the like, may be removably attached to the tip of the wand one at a time. The washing cloth and the drying cloth may each have an attachable loop that may removably attach to the tip of the wand. The tip of the wand and the removably attached cloth may be placed within a narrow hollow object to clean the interior surfaces.

Figure 1:
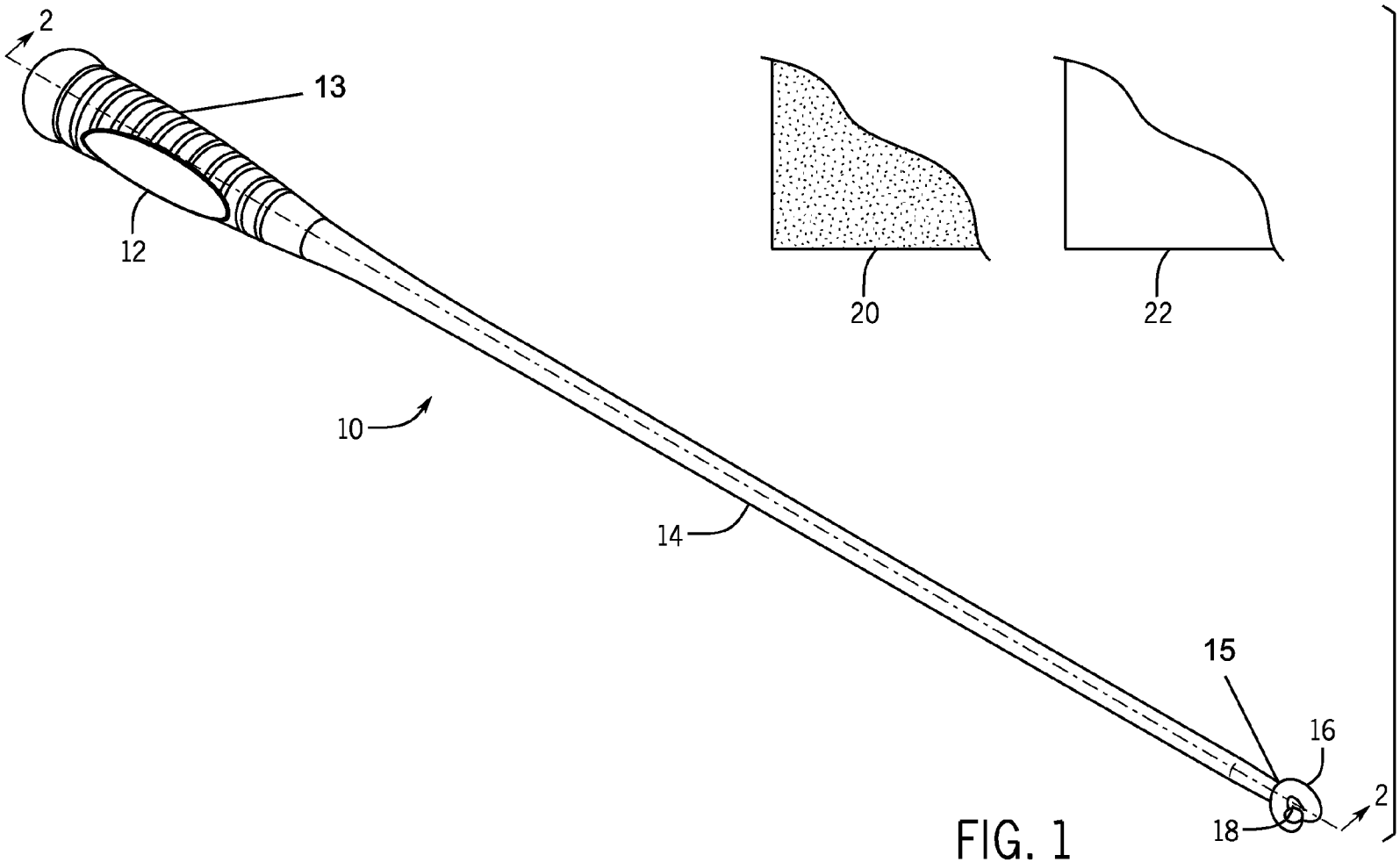
FIG. 1 is a perspective view of an exemplary embodiment of the present invention.
Figure 2:
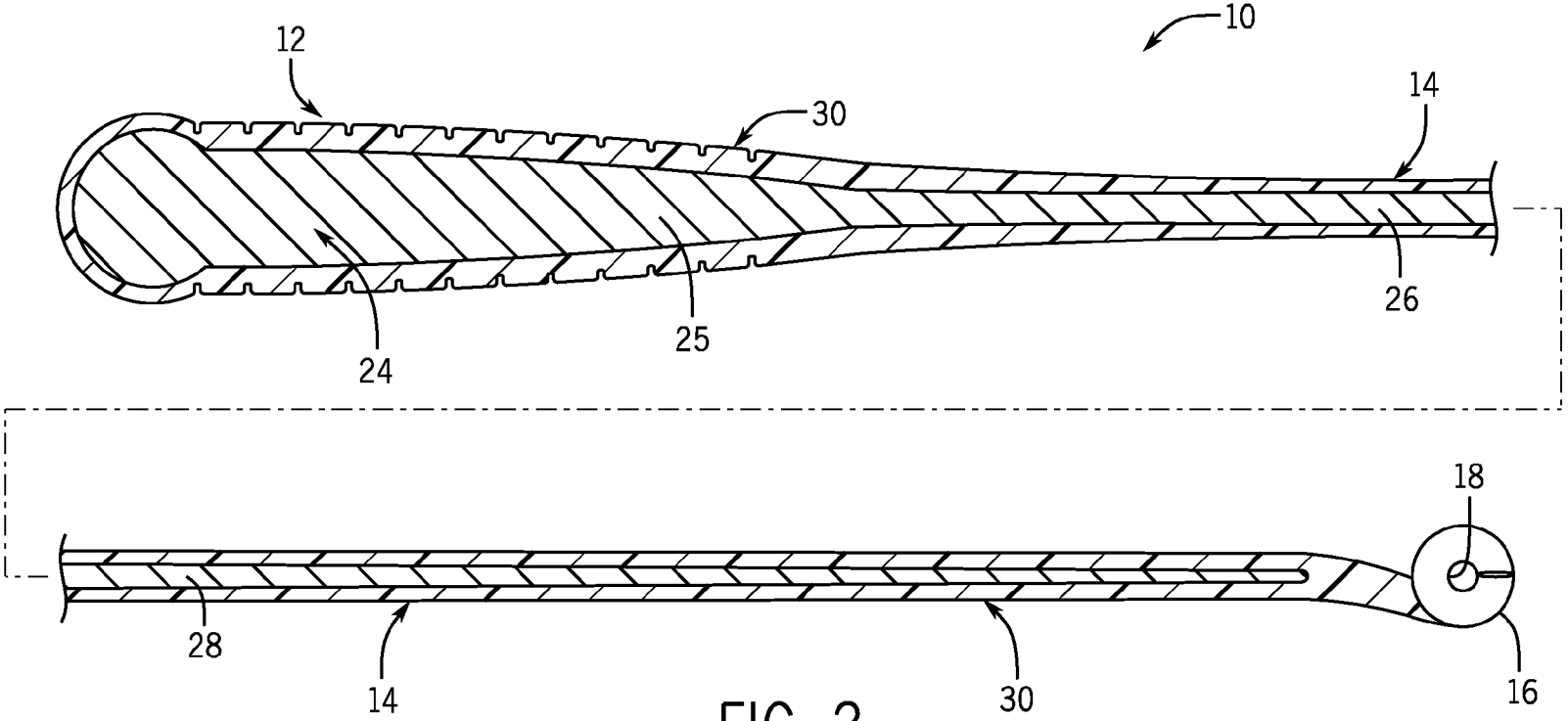
FIG. 2 is a cross-sectional view of an exemplary embodiment of the present invention taken on line 2-2 of FIG. 1.
Figure 3:
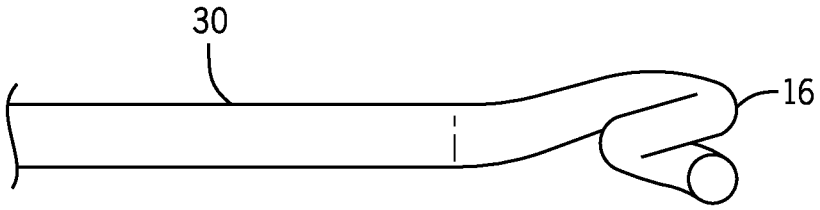
FIG. 3 is a detail top view of an exemplary embodiment of the present invention.
Figure 4:
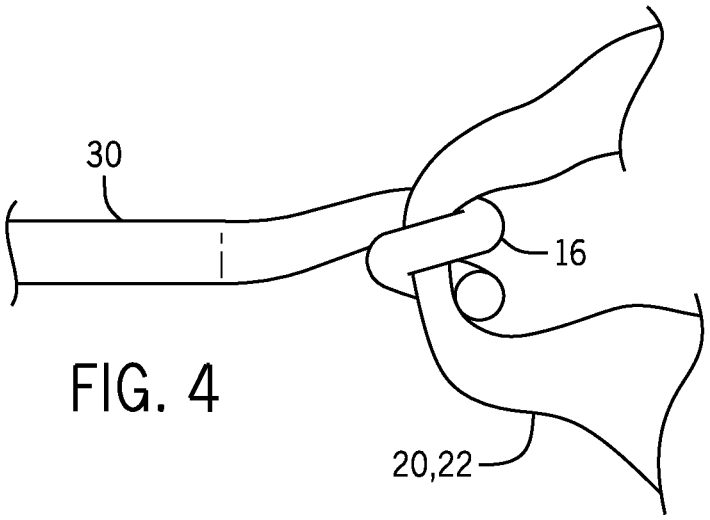
FIG. 4 is a detail top view of an exemplary embodiment of the present invention shown in use.

As is illustrated in FIGS. 1 through 4, a system for cleaning 10 may include a wand 14 having a first end 13 and a second end 15. The wand 14 may include a handle 12 on the first end 13. The second end 15 of the wand 14 may include a tip 16. The tip 16 may have an opening 18. The tip 16 may have at least one bend that may allow the opening 18 to be accessible.

The tip 16 may be in a coiled shape or form a helical coil along a helical axis transverse to a longitudinal axis of the wand 14, wherein a diameter of the helical coil defines the opening, as illustrated in FIGS. 1-4 the like. The helical coil formed by the tip 16 may complete at least one helical turn, but less than two full turns, as illustrated in FIGS. 1-4. A washing cloth 20 and a drying cloth 22 may be used with the wand 14. The wand 14 may be semi flexible.

In certain embodiments, the wand 14 may include a core 24 and a covering 30 over the core 24. In certain embodiments, the core 24 may be made from metal or the like. In certain embodiments, the covering 30 may be made from a rubber material or the like. In certain embodiments, the wand 14 may be made from plastic or the like. In certain embodiments, the wand 14 may include a handle portion 25 of the core 24 and a tip portion 28 of the core 24. In certain embodiments, the tip portion 28 of the core 24 may be tapered to be able to fit into small openings. In certain embodiments, an additional middle portion 26 may be between the handle portion 25 and the tip portion 28. The middle portion 26 may be tapered.

In certain embodiments, the washing cloth 20 may have a textured surface. The textured surface may allow the washing cloth 20 to pick up dirt and the like. In certain embodiments, the drying cloth 22 may be made from a microfiber or the like. The washing cloth 20 may have an attachable loop along one end of the washing cloth 20. The drying cloth 22 may have an attachable loop along one end of the drying cloth 22.

When washing an object, the washing cloth 20 may be removably attached to the tip 16 of the wand 14. In certain embodiments, the attachable loop of the washing cloth 20 may be looped around the tip 16 of the wand 14 with the attachable loop looped through the opening 18 of the tip 16. The washing cloth 20 may be used to wash the exterior and the interior of the object. In order to dry the object, a user may remove the washing cloth 20 from the wand 14 and removably attach the drying cloth 22 to the tip 16 of the wand 14. In certain embodiments, the attachable loop of the drying cloth 22 may be looped around the tip 16 of the wand 14 with the attachable loop looped through the opening 18 of the tip 16.

The tapered end of the wand 14 may allow for the tip 16 of the wand 14 to be able to enter into the narrow openings of objects. Removably securing the washing cloth 20 and alternatively, the drying cloth 22, to the tip 16 of the wand 14, allows the washing cloth 20 and the drying cloth 22 to be used within the interior of the object without having to obtain the washing cloth 20 and drying cloth 22 at a later time. Also, removably securing the washing cloth 20 and the drying cloth 22 to the wand 14 may allow for movement of the wand 14 within the interior of the object that may allow the washing cloth 20 and the drying cloth 22 to come in contact with the interior surface of the object. The washing cloth 20 and the drying cloth 22 contact with the interior surface of the object may allow for the cleaning of the interior surface of the object with minimal effort of the part of the user. The system allows for the washing and drying of the object with one product. In alternate embodiments, the system may be used for dusting.

It should be understood, of course, that the foregoing relates to exemplary embodiments of the invention and that modifications may be made without departing from the spirit and scope of the invention as set forth in the following claims.

What is claimed is:

1. A cleaning wand and cloth system comprising:

a wand extending along a longitudinal axis between a handle and a tip comprising an opening; and the tip forming a helical coil along a helical axis transverse to the longitudinal axis of the wand, wherein an inner diameter of the helical coil defines the opening, wherein the helical coil extends around the helical axis at least one turn but less than two turns; and a washing or drying cloth removably attached to the helical coil.

2. The cleaning wand and cloth system of claim 1, wherein the wand tapers towards the tip.

3. The cleaning wand and cloth system of claim 1, wherein the helical coil extends around the helical axis at least one and a quarter turns but less than two turns.

4. The cleaning wand and cloth system of claim 1, wherein the inner diameter is uniform.

5. A method for preparing a system to clean a narrow shaped hollow object comprising:

providing a wand extending along a longitudinal axis from a handle to a tip comprising an opening; wherein the tip forms a helical coil along a helical axis transverse to the longitudinal axis of the wand, wherein a diameter of the helical coil defines the opening; and a wash or dry cloth operatively engaging the opening.

6. The method of claim 5, wherein the wand tapers towards the tip.

* * * * *